US006343726B1

(12) United States Patent
Wu

(10) Patent No.: US 6,343,726 B1
(45) Date of Patent: Feb. 5, 2002

(54) HANGER SET

(76) Inventor: Tung-Yuan Wu, No. 37, Lane 333, Chung Te Rd., Tainan (TW)

( * ) Notice: Subject to any disclaimer, the term of this patent is extended or adjusted under 35 U.S.C. 154(b) by 0 days.

(21) Appl. No.: 09/924,686

(22) Filed: Aug. 9, 2001

(51) Int. Cl.[7] ..... A47G 25/14
(52) U.S. Cl. ..... 223/88; 223/89; 211/118
(58) Field of Search ..... 223/85, 89, 90, 223/94; 211/118, 115, 195

(56) References Cited

U.S. PATENT DOCUMENTS 1,937,911 A * 12/1933 Pajeau ..... 223/DIG. 1
2,166,592 A * 7/1939 Illig ..... 223/89
3,113,679 A * 12/1963 Smith ..... 211/118
5,405,065 A * 4/1995 Olson ..... 223/89

* cited by examiner

*Primary Examiner*—Bibhu Mohanty
(74) *Attorney, Agent, or Firm*—Rosenberg, Klein & Lee

(57) ABSTRACT

A hanger set includes a round main base and several hanging rods. The main base is connected to a main hanging rod hooked on a stationary holding object so as to be held at an elevated position, and has an upper sloping surface and a lower sloping surface. The upper sloping surface has elongated holes radially spaced out thereon, and the elongated holes each has a protruding part and a gap part opposing the protruding part on the lateral edges. The lower sloping surface has several pairs of upper and lower elongated holes radially spaced out thereon, and the upper and the lower elongated holes of each pair are aligned with each other to face a corresponding one of the elongated holes of the upper sloping surface with a pivotal part being interposed between each pair of elongated holes. The hanging rods each has a folded part, which is formed between a first engaging portion and a second hanging portion of the hanging rod, and retained under one of the pivotal parts, such that the hanging rod can be pivoted on the pivotal part between a horizontal in-use position and a vertical not-in-use position where the same is pushed up in such a manner as to cause the first engaging portion to move just past both the protruding part and the gap part to be retained thereby, thus, being secured in position without possibility of unwantedly stretching outward.

3 Claims, 7 Drawing Sheets

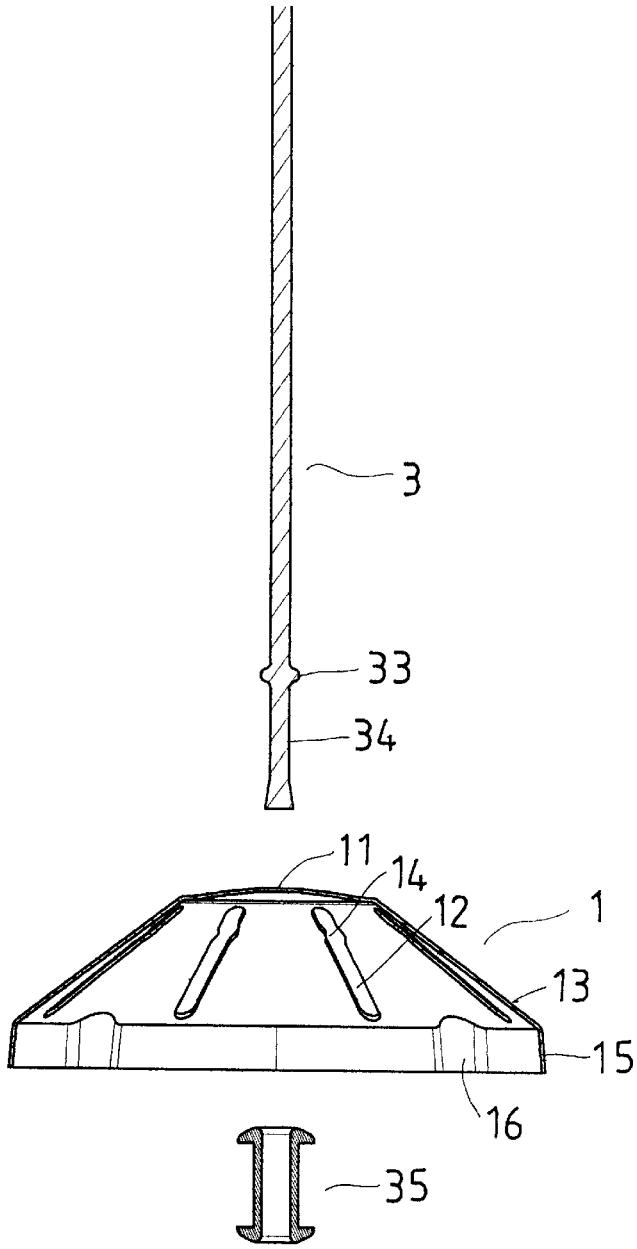
F I G. 2
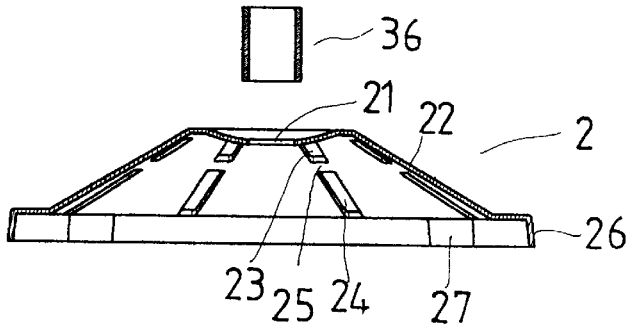

HANGER SET

BACKGROUND OF THE INVENTION

The present invention relates to a hanger set, and more particularly to a hanger set which consists of a main base and several radially arranged and spaced out hanging rods pivoted to the main base, and of which the hanging rods can be secured in a substantially perpendicular orientation relative to the bottom surface of the main base without possibility of unwantedly pivoting down when the hanger set is folded in a not-in-use position for easy storage.

Hanger sets are very popular that take the form of several hanging rods pivotally connected to a main base in a radial and spaced-out pattern because they can be used for hanging more clothes on for a given available space than a conventional hanger, which consists of a curved piece of wood or metal with a hook on it; the main base is connected to a main hanging rod at the center such that the hanger set can hang by means of the main hanging rod.

The radially arranged hanging rods can be moved to a substantially perpendicular orientation relative to the main base when the hanger set is not used so as to reduce the size of the hanger set. However, the radially arranged rods are not provided with a securing means for fastening the same in the upright not-in-use position after the same have been pivoted up. Consequently, the hanging rods are likely to unwanted pivot down from the upright position to cause the user inconvenience.

SUMMARY OF THE INVENTION

Therefore, it is a main object of the present invention to provide a hanger set, of which the radially arranged hanging rods pivoted to the main base can be easily moved between a horizontal in-use position and a substantially perpendicular not-in-use orientation relative to the main base, and of which the hanging rods can be secured in the not-in-use position without possibility of unwantedly pivoting down.

The main base includes an upper part having a truncated-cone shape with an upper narrow end being cut out and an upper sloping surface as well as a lower part having a truncated-cone shape same as the upper part and a lower sloping surface. The sloping surface of he upper part has elongated holes radially spaced out, while the sloping surface of the lower part has pairs of aligned upper and lower elongated holes radially spaced out thereon to face a corresponding one of the elongated holes of the upper part. The elongated holes of the upper part each further has an engaging element consisting of a protruding part and a gap part opposing the protruding part on lateral edges. A pivotal part is formed between each pair of upper and lower elongated holes of the lower part.

The hanging rods each has a folded part, and a hanging part and an engaging end portion formed substantially parallel to the hanging part; the folded part is interposed between the hanging part and the engaging end portion. The hanging rods are each pivoted to a respective one of the pivotal parts of the base lower part with the folded part being retained under the pivotal part, and the hanging part and the engaging end portion sticking up from the lower and the upper elongated holes respectively.

Thus, when the hanging rods are pivoted from the horizontal in-use position to the vertical not-in-use position, the engaging end portions are moved upward past the engaging elements to engage the protruding parts of the engaging elements of the base upper part for the hanging rods to be secured in position.

BRIEF DESCRIPTION OF THE DRAWINGS

This invention will be better understood by referring to the accompanying drawings, wherein:

FIG. 2 is an exploded cross-sectional view of the hanger set of the present invention.

FIG. 6 is a fragmentary side view of the hanger set of the present invention with a sheet being hung on.

DETAILED DESCRIPTION OF THE PREFERRED EMBODIMENTS

Figure 1:
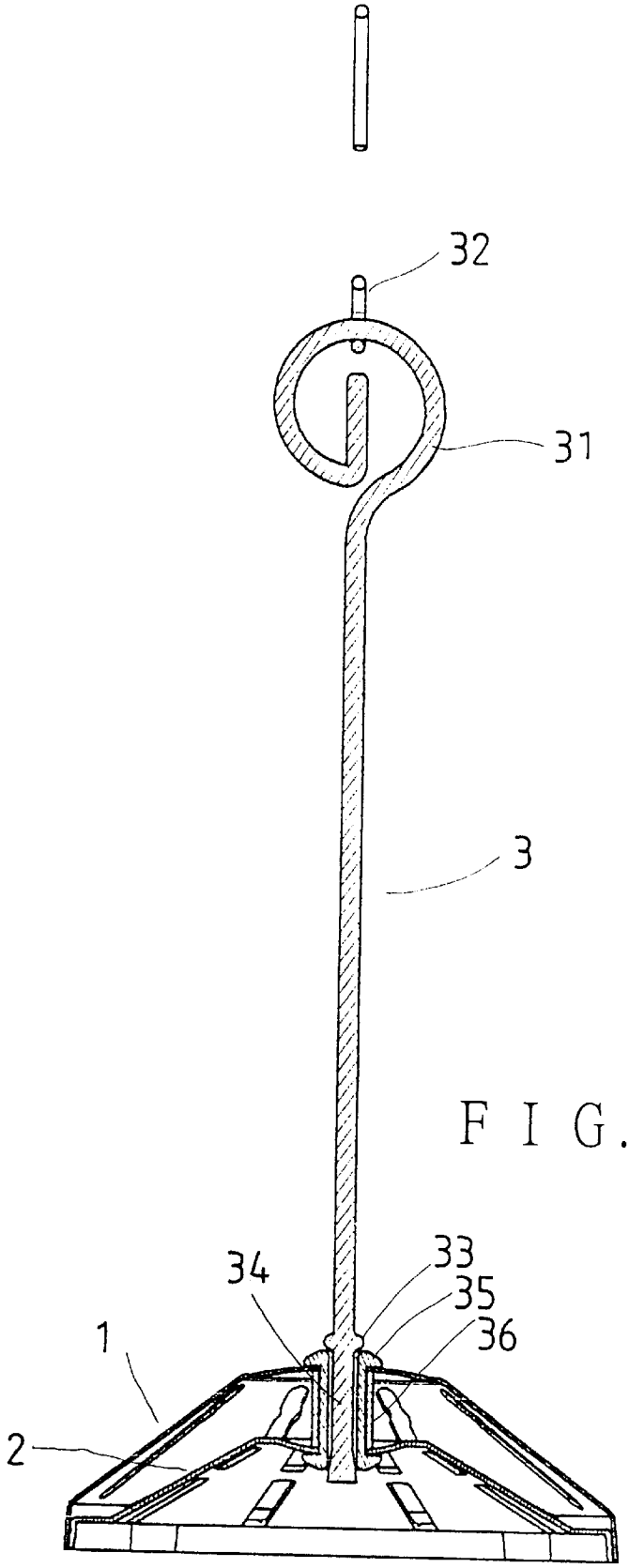
FIG. 1 is a cross-sectional view of the hanger set of the present invention.
Figure 3:
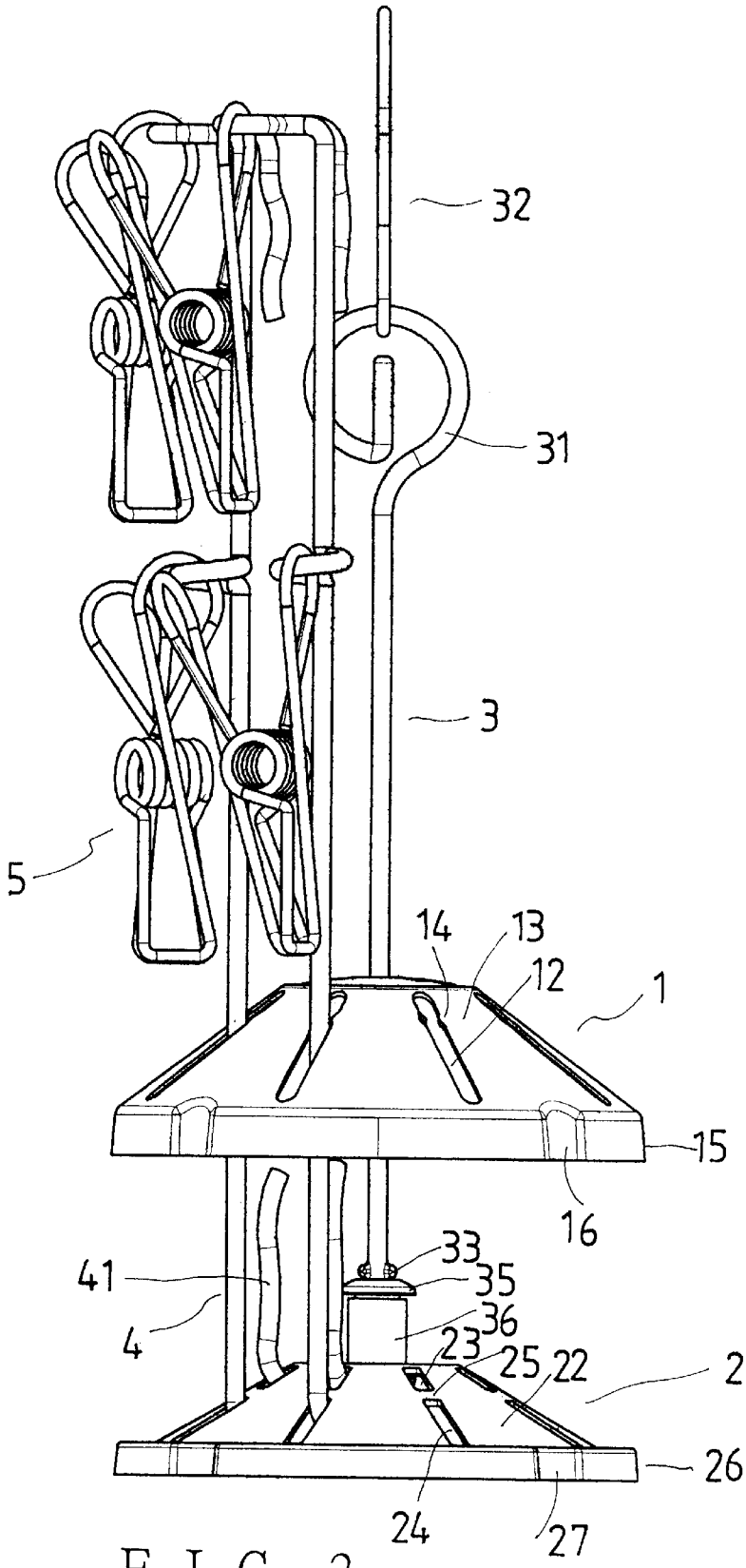
FIG. 3 is a side view of the hanger set of the present invention in the assembling process.

Referring to FIGS. 1, 2 and 3, a hanger set of the present invention includes a round main base consisting of both an upper part 1 and a lower part 2, a main hanging rod 3 and several hanging rods 4. The hanging rods 3 and 4 are made of stainless metals that have good flexibility.

The upper part 1 of the main base is shaped like a truncated cone with the narrow end being cut out, and has a central hole 11, a sloping surface 13, a lower annular wall 15 and several elongated holes 12; the lower annular wall 15 is connected to the lower end of the sloping surface 13; the elongated holes 12 are radially arranged and spaced out on the sloping surface 13, and each has an engaging element 14 including a protruding part and a gap part opposing the protruding part; the lower annular wall 15 is formed with several concave parts 16 on the outer side, which each has a corresponding convex part on the inner side of the annular wall 15.

The lower part 2 of the main base is also shaped like a truncated cone with the narrower end being cutout such that the same can be closely received in the upper part 1. The lower part 2 further has a central hole 21 (FIG. 2), a sloping surface 22, a lower annular wall 26 connected to the lower end of the sloping surface 22 and several pairs of upper and lower elongated holes 23 and 24; the upper elongated holes 23 are each aligned with a corresponding one of the lower elongated holes 24, and are radially arranged and spaced out on the sloping surface 22 so that the lower elongated holes 24 are radially disposed and spaced out on the sloping surface 22. Each pair of upper and lower elongated holes 23 and 24 have a pivot part 25 interposed between same. The lower annular wall 26 is formed with concave parts 27 on the outer surface such that each part of aligned upper and lower respective one of the elongated holes 23 and 24 can face a respective one of the elongated holes 12 of the upper base part 1 when the concave parts 27 are tightly mounted on the convex parts of the inner side of the lower annular wall 15 to connect the lower base part 2 to the upper one 1.

The main hanging rod 3 has a hooked part 31 at the upper end, a connecting portion 34 at the lower part and a protruding part 33 above the connecting portion 34. The connecting portion 34 is passed through the central hole 11 of the upper base part 1, and fixedly connected to an inner bushing 35 with the protruding part 33 being positioned above the inner bushing 35; the inner bushing 35 is connected to an outer bushing 36 fixedly connected to the central hole 21 of the lower part 2, so that the main hanging rod 31 can hold the main base and the hanging rods 4, which will be detailed next, when the hooked part 31 is connected to a movable hook 32 connected to a stationary holding object (not shown) such as ceiling and transverse rods. Rivets can be used for firmly connecting the bushings 35 and 36 to the main hanging rods 3 and the parts 1 and 2.

Figure 5:
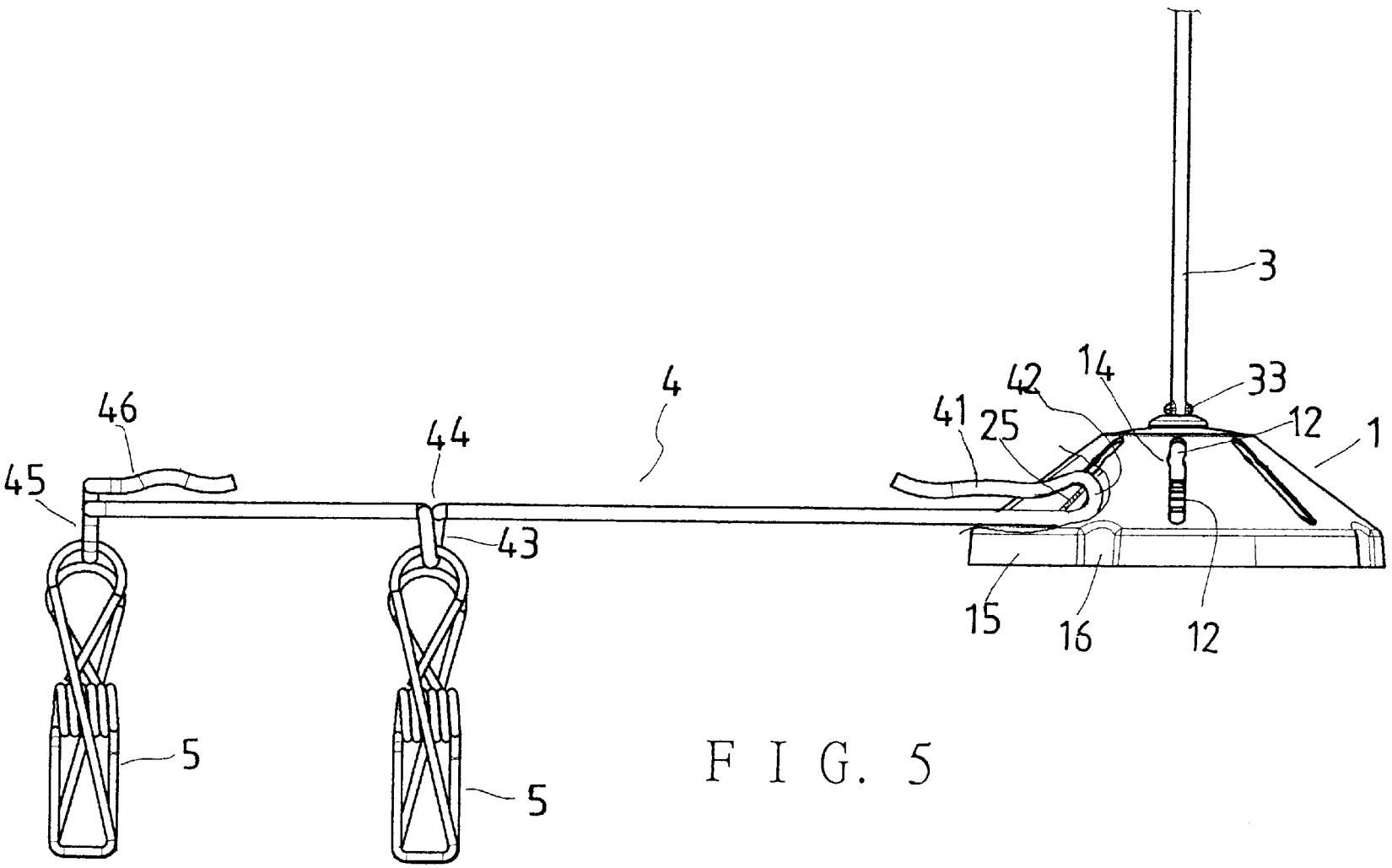
FIG. 5 is a fragmentary side view of the hanger set of the present invention.
Figure 6:
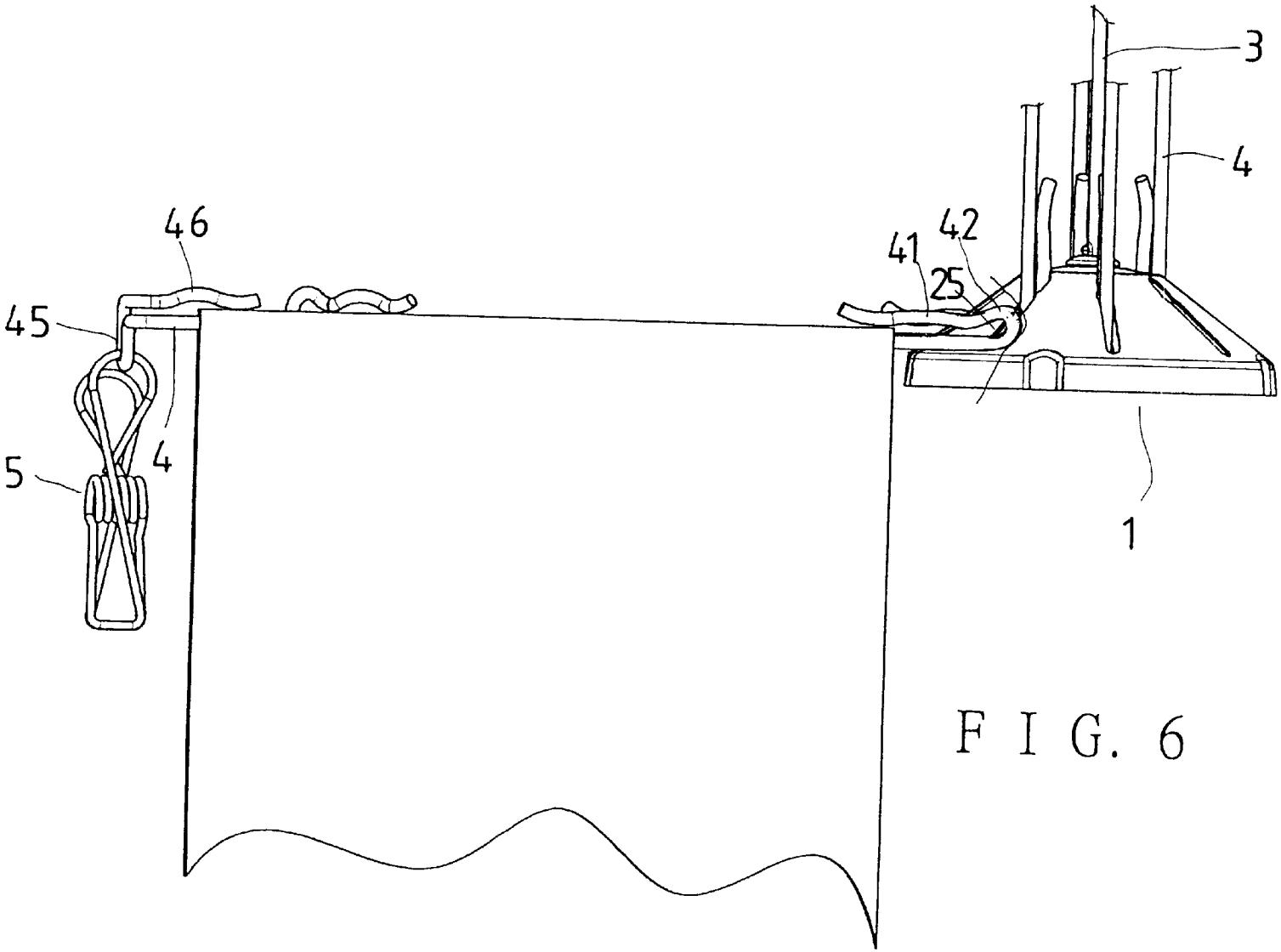
Figure 7:
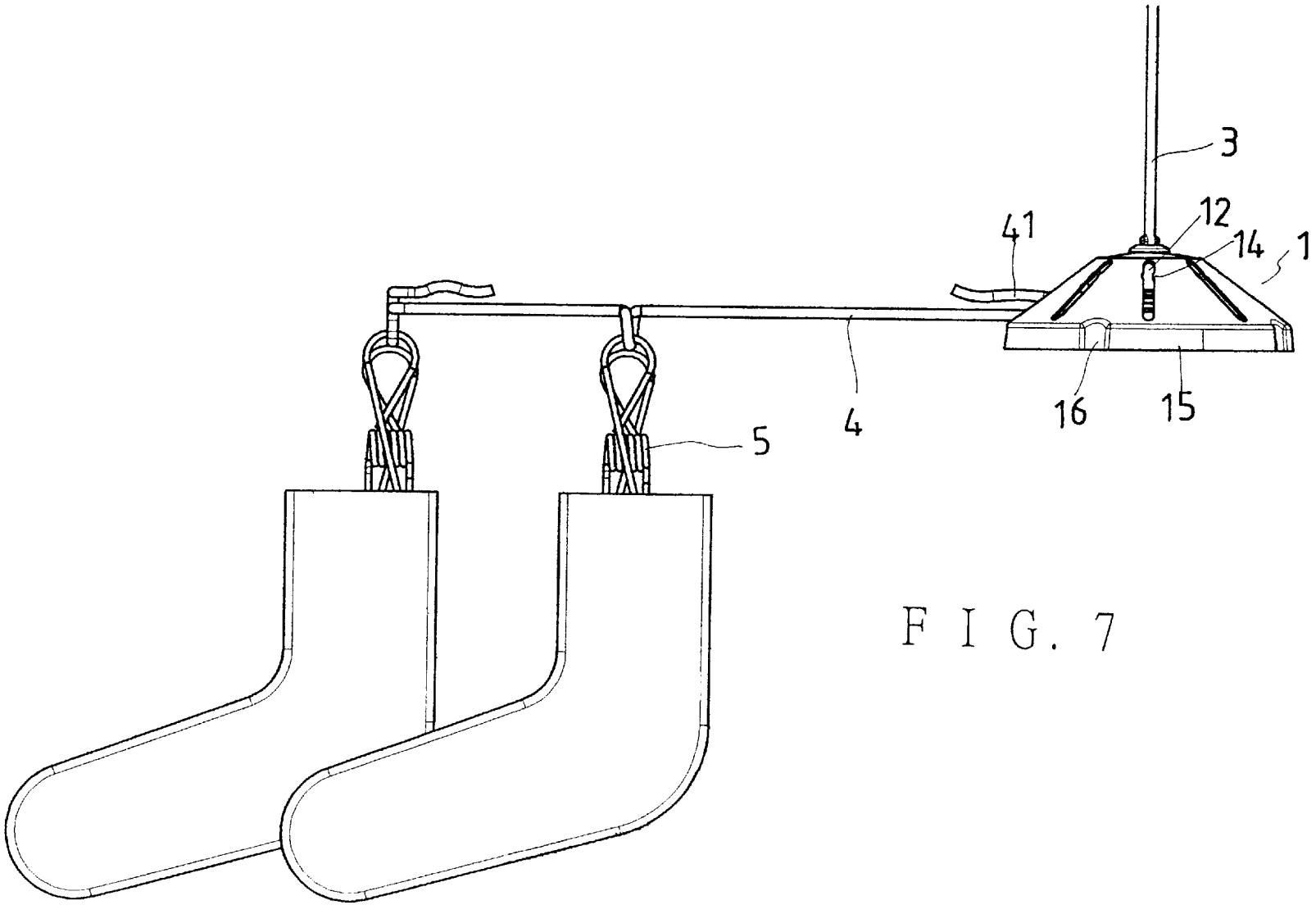
FIG. 7 is a fragmentary side view of the hanger set of the present invention with clothes being hung on the clips.

The hanging rods 4 are used for hanging clothes on, and each has a folded part 42 (FIG. 5), which is preferably rounded at the close end, an engaging end portion 41 at the inner end and an upward-bent elastic securing part 46 at the outer end. The diameters of the hanging rods 4 are only sightly smaller than the width of the elongated holes 12, 23 and 24. The hanging rods 4 are each movably connected to the main base at the inner end with the folded part 42 being retained under the pivotal part 25 of the lower base part 2 and with the engaging end portion 41 and the rest of the hanging rod 4 being arranged at a respective side of the pivotal part 25 such that the hanging rods 4 can be pivoted on a respective one of the pivotal part 25, and are radially positioned for hanging clothes on when they are pivoted down to a horizontal in-use position. The engaging end portion 41 and the elastic securing parts 46 can be used for securing large clothes or bed sheet hung on the main parts of the hanging rods 4 as shown in FIG. 6. The hanging parts 4 each can be formed with a hook at the outer end as those of the conventional hanger sets, but is preferably formed with several ring-shaped parts 43, and a hooking part 45 at the middle part and the outer end respectively so that clips 5 can be hooked thereon for allowing more clothes to be hung on the hanger set; the ring-shaped parts 43 and the hooking parts 45 each has an aperture 44 on the upper end so that the clips 5 can be passed thereinto as shown in FIG. 5.

Figure 4:
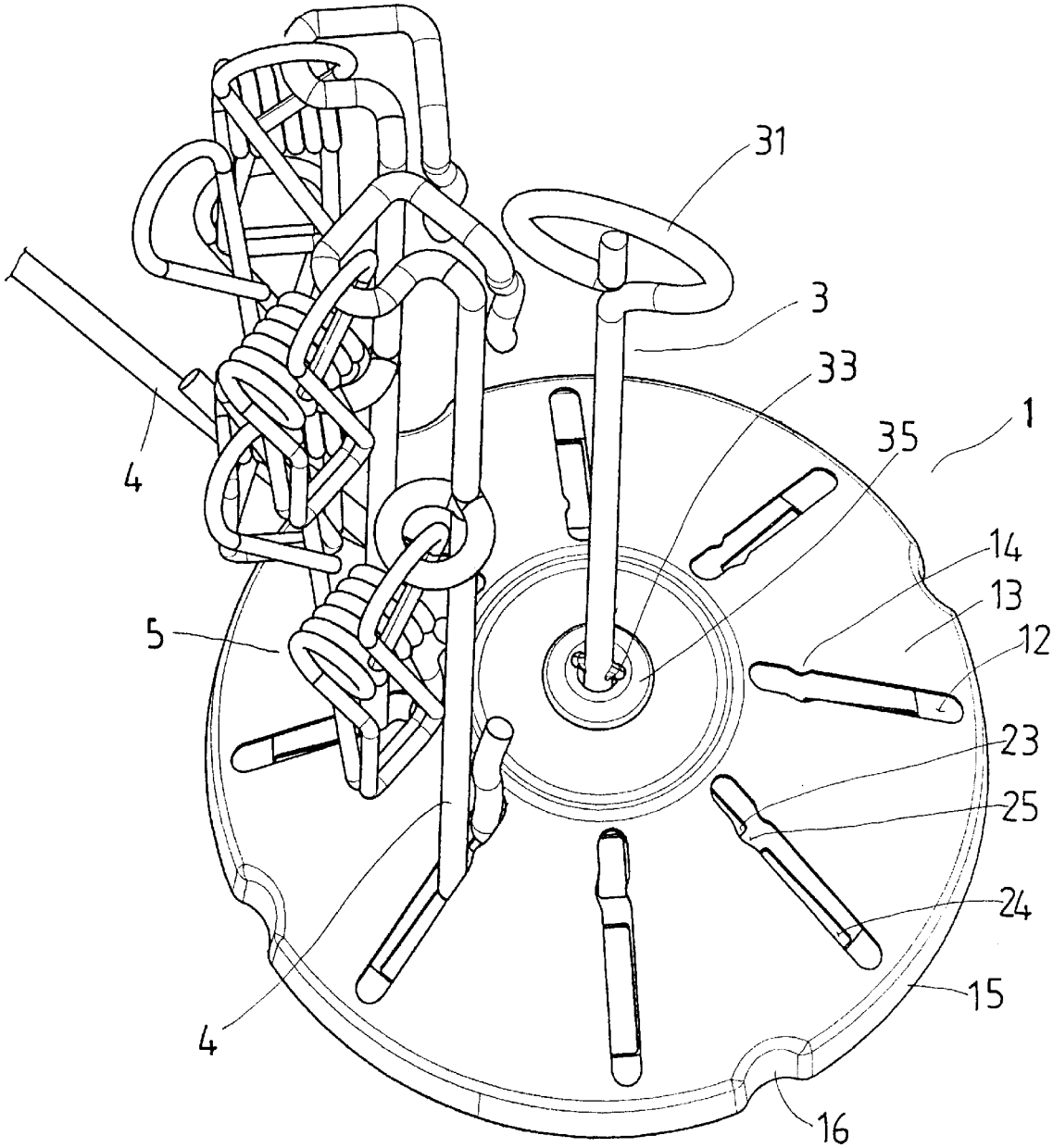
FIG. 4 is a fragmentary perspective view of the hanger set of the present invention.

The hanging rods 4 are pivoted up to a substantially perpendicular orientation relative to the flat bottom of the main base when the hanger set is not used, so that the hanger set occupies less space; referring to FIG. 4, when the hanging rods 4 are pivoted up about the pivotal parts 25, the same should be pushed in such a manner as to cause the engaging end portions 41 to move just past the engaging elements 14 for the protruding parts of the engaging elements 14 to be interposed between the engaging end portions 41 and the rest of the hanging rods 4. Thus, the hanging rods 4 are secured in position with the protruding parts of the engaging elements 14 stopping the engaging end portions 41 from pivoting down.

In addition, some of the hanging rods 4 can be secured in the upright not-in-use position, while the others in the horizontal in-use position for hanging clothes of large size on.

From the above description, it can be easily understood that the hanger set of the present invention has the following desirable features:

1. The hanging rods are made of stainless metal bent to desired shape, so they have enduring flexibility, and won't break due to clothes of large weight or rust.
2. When the hanging rod is moved to the horizontal in-use position, the engaging end portion will engage the engaging element consisting of the opposing protruding part and gap part so as to be helpful in keeping the hanging rod in a stable condition, avoiding fall-off of the clothes caused by shaking of the hanging rods.
3. The engaging end portions of the hanging rods are positioned just above the engaging element of the upper base part when the hanger set is not used and folded, in other words, the protruding parts of engaging elements will stop the engaging portions from the moving past the same. Of course, the protruding parts of the engaging elements will also stop the rest of the hanging rods from moving further inwardly to pass the same. So, the hanging rods are secured in position when the hanger set is folded. And, the hanging rods each can be pivoted about the pivotal part on a same plane without shaking sideways with the help of the edges of the elongated holes 12, 23 and 24.
4. The hanger set can be adjusted for clothes of larger size by means of positioning some of the hanging rods in the horizontal position and securing the others in the upright position.
5. The hanger set can be used for hanging more clothes on with the clips hooked on the middle parts and the outer ends of the hanging rods.
6. Clothes of large size of bed sheet can be held on the main parts of the hanging rods and securing in position by the engaging end portions and the outer end elastic securing parts, so that hanger set is easy to use and has a wide range of application.
7. The upper base part can be correctly connected to the lower base part with the help of the concave parts of the lower annular walls of both.

What is claimed is:

1. A hanger set, comprising a round main base, said main base being connected to a main hanging rod hooked on a stationary holding object so as to be held at an elevated position;

a plurality of hanging rods radially arranged and spaced out from said round main base; the base characterized by an upper part having a truncated-cone shape with an upper narrow end being cut out and a sloping surface, the base having a lower part having a truncated-cone shape with an upper narrow end being cut out and a sloping surface; said lower part being closely received in said upper part to form said main base;

the upper part having elongated holes, said elongated holes being radially spaced out on said upper part sloping surface of said round main base; said elongated holes each being formed with an engaging element consisting of a protruding part and a gap part opposing said protruding part on lateral edges;

the lower part having pairs of upper and lower elongated holes, said pairs of upper and lower elongated holes being radially spaced out on said lower part sloping surface of said round main base; said upper and lower elongated holes of each pair being aligned with each other to face a corresponding one of said elongated holes of said upper part; each pair of said upper and lower elongated holes having a pivotal part of said lower base part interposed therebetween;

a folded part at each of said hanging rods; said folded part being formed between a first engaging end portion and a second portion of said hanging rod; said folded parts being each retained under a respective one of said pivotal parts of said lower base part for allowing said engaging end portion and said second portion to be pivotally positioned on a respective side of said pivotal part;

whereby said radially spaced hanging rods can be pivoted on said pivotal parts between a horizontal in-use position and a substantially perpendicular not-in-use orientation relative to a flat bottom of said main base where said hanging rods are pushed up in such a manner as to cause said engaging end portions to move just past said engaging elements to be retained by said protruding parts of said engaging elements, thus being secured in position for allowing the size of said hanger set to be reduced.

2. The hanger set as claimed in claim 1, said upper part and said lower part of said round main base have equal number of concave parts on lower outer annular edges respectively; said concave parts of said upper base part having convex parts on an inner side corresponding to said concave parts so as to help said upper base part to be connected to said lower base part in a position where said elongated holes of said upper parts face a respective pair of said upper and lower elongated holes of said lower base parts when said concave parts of said lower base parts are fitted onto said convex parts of said upper base parts.

3. The hanger set as claimed in claim 1, wherein said elongated holes of said upper and said lower base parts have a width just slightly bigger than a diameter of said radially spaced hanging rods so as to help each of said hanging rods pivot up and down in a same plane without shaking sideways.

* * * * *